US012571135B2

(12) United States Patent
Lee et al.

(10) Patent No.: US 12,571,135 B2
(45) **Date of Patent: *Mar. 10, 2026**

(54) POLYETHYLENE YARN WITH IMPROVED DIMENSIONAL STABILITY AND FUNCTIONAL FABRIC INCLUDING THE SAME

(71) Applicant: KOLON INDUSTRIES, INC., Seoul (KR)

(72) Inventors: Sinho Lee, Seoul (KR); Young Soo Lee, Seoul (KR); Seong-Young Kim, Seoul (KR); Jung Eun Park, Seoul (KR)

(73) Assignee: KOLON INDUSTRIES, INC., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 18/713,654

(22) PCT Filed: Dec. 6, 2022

(86) PCT No.: PCT/KR2022/019719
§ 371 (c)(1),
(2) Date: May 26, 2024

(87) PCT Pub. No.: WO2023/106799
PCT Pub. Date: Jun. 15, 2023

(65) Prior Publication Data

US 2025/0011976 A1 Jan. 9, 2025

(30) Foreign Application Priority Data

Dec. 8, 2021 (KR) ..... 10-2021-0175083

(51) Int. Cl.
*D02G 3/02* (2006.01)
*D03D 15/283* (2021.01)

(52) U.S. Cl.
CPC ..... *D02G 3/02* (2013.01); *D03D 15/283* (2021.01); *D10B 2321/021* (2013.01); *D10B 2401/04* (2013.01); *D10B 2401/063* (2013.01)

(58) Field of Classification Search
None
See application file for complete search history.

(56) References Cited

U.S. PATENT DOCUMENTS

2022/0380948 A1* 12/2022 Kim ..... D01D 5/098
2023/0322979 A1* 10/2023 Lee ..... C08F 110/02 526/352

(Continued)

FOREIGN PATENT DOCUMENTS

JP 3172189 B2 6/2001
JP 3234327 B2 12/2001

(Continued)

OTHER PUBLICATIONS https://patents.google.com/patent/KR20200036171A/en?oq=2020-0036171 (Year: 2020).*

(Continued)

*Primary Examiner* — Arti Singh-Pandey
(74) *Attorney, Agent, or Firm* — Harvest IP Law, LLP

(57) ABSTRACT

Provided are a polyethylene yarn having improved dimensional stability and a functional fabric including the same, and more particularly, a polyethylene yarn having improved dimensional stability, which may prevent shape deformation after post-processing such as weaving and cutting, and a functional fabric including the yarn to provide a user with a cool feeling are provided.

10 Claims, 4 Drawing Sheets

(56) References Cited

U.S. PATENT DOCUMENTS

| | | | | |
|---|---|---|---|---|
| 2023/0357965 | A1* | 11/2023 | Lee | D02G 3/02 |
| 2023/0357966 | A1* | 11/2023 | Lee | D01F 6/04 |
| 2023/0371626 | A1* | 11/2023 | Chung | A61F 7/02 |
| 2023/0392296 | A1* | 12/2023 | Lee | D01F 6/04 |
| 2025/0034760 | A1* | 1/2025 | Lee | D03D 15/283 |

FOREIGN PATENT DOCUMENTS

| | | | | | |
|---|---|---|---|---|---|
| KR | 10-2012-0095733 | A | | 8/2012 | |
| KR | 10-2016-0059653 | A | | 5/2016 | |
| KR | 10-2019-0000540 | A | | 1/2019 | |
| KR | 10-2020-0036171 | A | | 4/2020 | |
| KR | 10-2020-0043089 | A | | 4/2020 | |
| KR | 20200036171 | A | * | 4/2020 | D01F 6/04 |
| TW | I727576 | B | | 5/2021 | |
| TW | 202130865 | A | | 8/2021 | |
| WO | 2012-117596 | A1 | | 9/2012 | |
| WO | 2013-168543 | A1 | | 11/2013 | |
| WO | 2021-132768 | A1 | | 7/2021 | |
| WO | 2021-132769 | A1 | | 7/2021 | |
| WO | 2021-132972 | A1 | | 7/2021 | |

OTHER PUBLICATIONS

PCT International Search Report dated Mar. 10, 2023.

The Office Action dated May 20, 2025, of the corresponding Japanese Patent Application.

The Notice of Allowance dated Oct. 21, 2025 of the corresponding Japanese Patent Application.

The extended European Search Report dated Jul. 11, 2025, of the corresponding European Patent Application.

* cited by examiner

【FIG. 1】
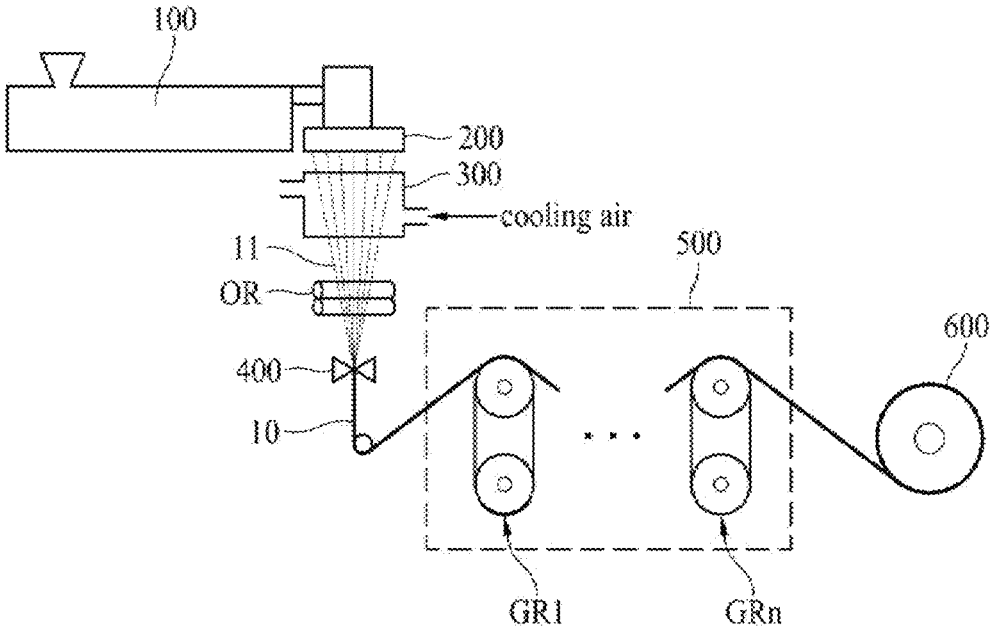

【FIG. 2】
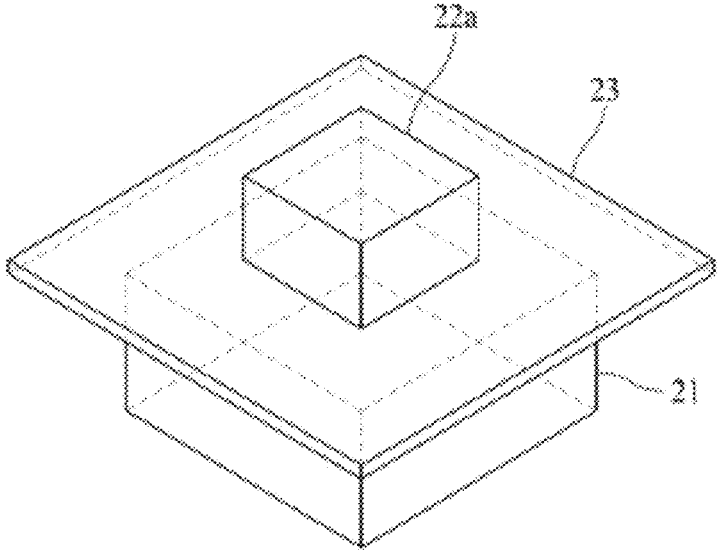
【FIG. 3】
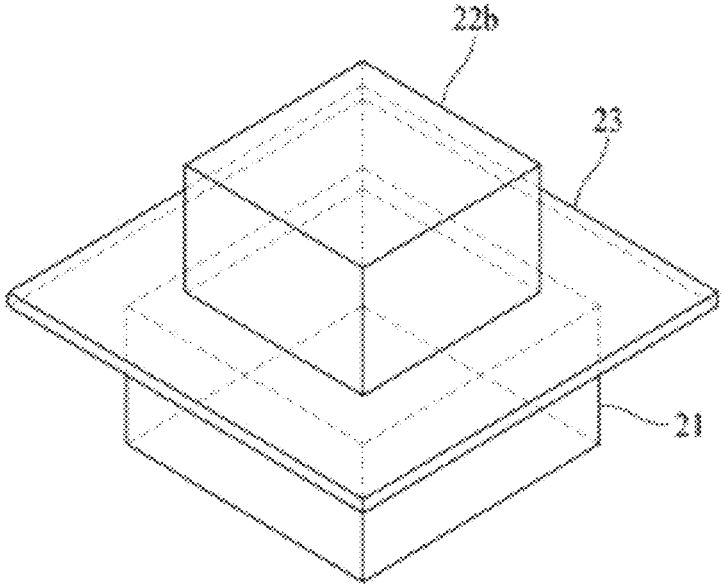

【FIG. 4】
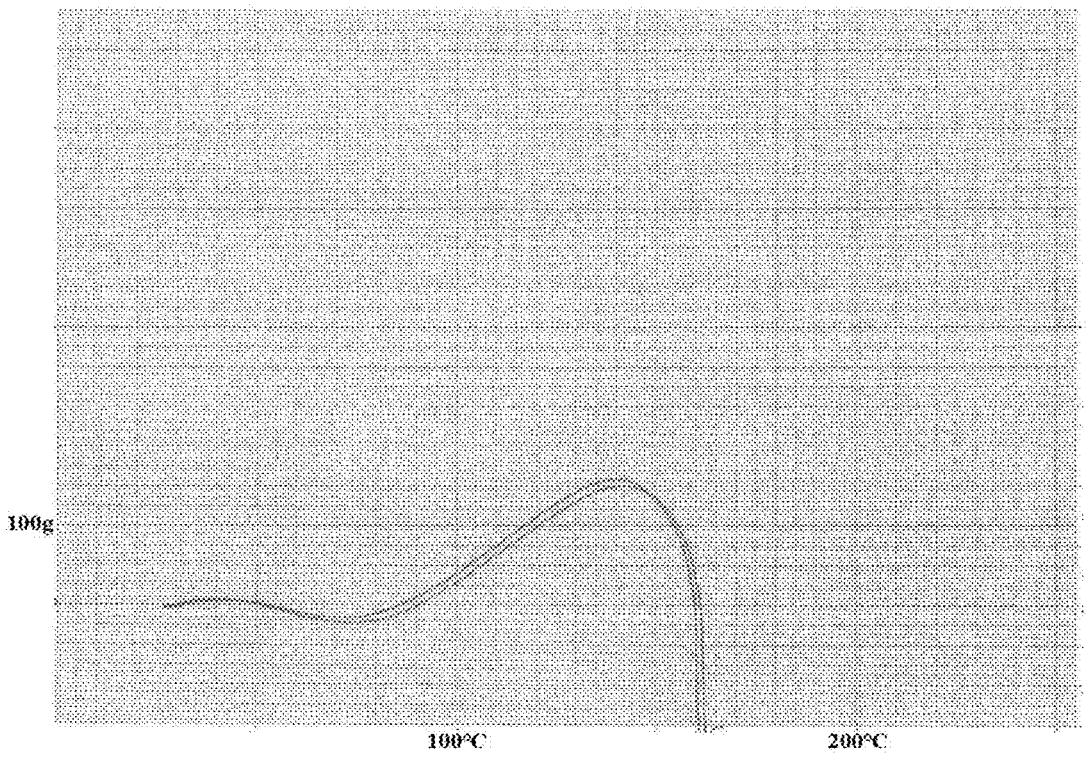

【FIG. 5】
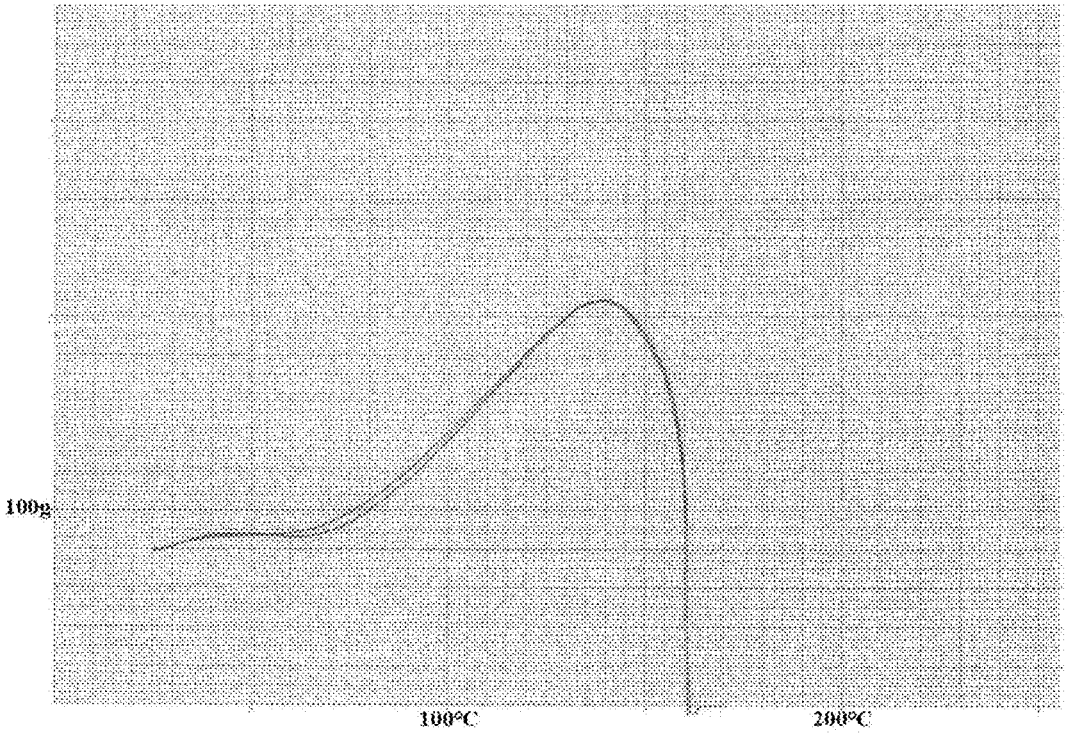

POLYETHYLENE YARN WITH IMPROVED DIMENSIONAL STABILITY AND FUNCTIONAL FABRIC INCLUDING THE SAME

CROSS REFERENCE TO RELATED APPLICATION(S)

This application is a National Stage of International Application No. PCT/KR2022/019719 filed on Dec. 6, 2022, claiming priority based on Korean Patent Application No. 10-2021-0175083 filed on Dec. 8, 2021, the disclosure of which are incorporated herein by reference in their entireties.

TECHNICAL FIELD

The following disclosure relates to a polyethylene yarn having improved dimensional stability and a functional fabric including the same, and more particularly, to a polyethylene yarn having improved dimensional stability so that it has a low dimensional deformation rate in post-processing such as weaving and cutting, and a functional fabric including the same.

BACKGROUND OF ART

In recent years, due to improvements in living standards, population growth, and the like, a fiber demand is changing from general purpose yarn for general clothing and industrial fiber to high-function and high-performance, advanced fiber materials having various functions. In particular, development of a fiber material having a cool feeling to impart a comfort feeling to a user in summer or in a high-temperature working environment is actively in progress.

A cool feeling is imparted to a cool feeling fiber material by using thermal conductivity of the fiber itself, or by adjusting thermal conductivity on the surface of the fiber material by a coating of a metal component having a high thermal conductivity and the like. In particular, a cool feeling fiber material using the thermal conductivity of the fiber itself may be manufactured only by a weaving process of a fabric and may maintain the cool feeling even after washing, and thus, is produced substantially in various industrial fields.

Conventionally, attempts are being made to apply a cool feeling fiber material using the thermal conductivity of the fiber itself to various fields of technical fiber and fashion clothing requiring a high cool feeling such as sportswear, climbing clothes, and working clothes, using excellent thermal conductivity of a high molecular weight polyethylene (HMWPE) fiber, as disclosed in Japanese Patent Registration Publication No. JP 2010-236130 A and Korean Patent Laid-Open Publication No. 10-2017-0135342.

However, since the cool feeling polyethylene yarn as such includes a high molecular weight polyethylene having a high viscosity, when manufacturing the yarn, the manufacture is difficult due to the low melt flowability of the raw material. Thus, in order to improve the melt flowability of the raw material, a raw material including a high molecular weight polyethylene having a high viscosity is diluted to produce the yarn, but additional problems of complicating the process and making solvent management and recovery difficult arise.

Meanwhile, a low molecular weight polyethylene fiber having a low viscosity is disadvantageous for post-processing such as weaving, knitting, and heat treatment, due to its low strength, high elongation, and low dimensional stability, as compared with the high molecular weight polyethylene fiber having a high viscosity. Thus, the low molecular weight polyethylene fiber has low industrial availability as compared with the high molecular weight polyethylene fiber and is not utilized for various applications.

DETAILED DESCRIPTION OF THE INVENTION

Technical Problem

An embodiment of the present invention is directed to providing a polyethylene yarn having improved dimensional stability so that it has a low dimensional deformation rate in post-processing such as weaving and cutting, and a functional fabric which includes the yarn to provide a user with a cool feeling.

Technical Solution

In one general aspect, a polyethylene yarn having a maximum thermal shrinkage stress of 0.1 to 0.7 g/d and a melt index (MI, @190° C.) of 5 to 25 g/10 min is provided.

In the polyethylene yarn according to an exemplary embodiment of the present invention, the yarn may have a polydispersity index (PDI) of 5 to 20 and a number average molecular weight (Mn) of 1000 to 10,000 g/mol.

In the polyethylene yarn according to an exemplary embodiment of the present invention, the yarn may have a strength of 6 to 17 g/d as measured according to ASTM D2256 and an elongation of 10 to 25%.

In the polyethylene yarn according to an exemplary embodiment of the present invention, the yarn may have a crystallinity of 65 to 85%.

In the polyethylene yarn according to an exemplary embodiment of the present invention, the yarn may have a density of 0.92 to 0.97 g/cm$^3$.

In another general aspect, a functional fabric includes the polyethylene yarn described above.

In the functional fabric according to an exemplary embodiment of the present invention, the fabric may have a cool feeling on contact of 0.05 to 0.25 W/cm$^2$, as measured by bringing the fabric at 20±2° C. into contact with a hot plate (T-box) at 30±2° C. under the conditions of 20±2° C. and 65±2% R.H.

In the functional fabric according to an exemplary embodiment of the present invention, the fabric may have a thermal conductivity of 0.05 to 0.25 W/mK, as measured by bringing the fabric at 20±2° C. into contact with a heat source plate (BT-box) at 30±2° C. under the conditions of 20±2° C. and 65±2% R.H.

In the functional fabric according to an exemplary embodiment of the present invention, the fabric may have a surface density of 150 to 800 g/m$^2$.

In still another general aspect, a cool feeling product manufactured from the fabric described above is provided.

Advantageous Effects

The polyethylene yarn according to the present invention is a low molecular weight polyethylene yarn, but has excellent dimensional stability, and may have excellent thermal conductivity.

In addition, the functional fabric according to the present invention includes a polyethylene yarn having excellent thermal conductivity and high dimensional stability, and thus, has a cool feeling and prevents shape deformation even after post-processing, thereby having excellent quality.

BRIEF DESCRIPTION OF DRAWINGS

FIG. 1 is a schematic diagram which schematically illustrates a device for manufacturing a polyethylene yarn.

FIG. 2 is a schematic diagram which schematically illustrates a device for measuring a cool feeling on contact with a fabric.

FIG. 3 is a schematic diagram which schematically illustrates a device for measuring thermal conductivity in a thickness direction of a fabric.

FIG. 4 is a thermal shrinkage stress graph of a fabric according to Example 1.

FIG. 5 is a thermal shrinkage stress graph of a fabric according to Example 7.

DETAILED DESCRIPTION OF THE EMBODIMENTS

Technical terms and scientific terms used in the present specification have the general meaning understood by those skilled in the art to which the present invention pertains unless otherwise defined, and a description for the known function and configuration obscuring the gist of the present invention will be omitted in the following description and the accompanying drawings.

In addition, the singular form used in the present specification may be intended to also include a plural form, unless otherwise indicated in the context.

In addition, units used in the present specification without particular mention is based on weights, and as an example, a unit of % or ratio refers to a wt % or a weight ratio and wt % refers to wt % of any one component in a total composition, unless otherwise defined.

In addition, the numerical range used in the present specification includes all values within the range including the lower limit and the upper limit, increments logically derived in a form and span in a defined range, all double limited values, and all possible combinations of the upper limit and the lower limit in the numerical range defined in different forms. Unless otherwise defined in the specification of the present invention, values which may be outside a numerical range due to experimental error or rounding of a value are also included in the defined numerical range.

The term "comprise" in the present specification is an open-ended description having a meaning equivalent to the term such as "is/are provided", "contain", "have", or "is/are characterized", and does not exclude elements, materials, or processes which are not further listed.

Since a conventional cool feeling polyethylene yarn includes a high molecular weight polyethylene having a high viscosity, when manufacturing the yarn, the manufacture is difficult due to the low melt flowability of the raw material. Thus, in order to improve the melt flowability of the raw material of the polyethylene yarn, a raw material including a high molecular weight polyethylene having a high viscosity is diluted to produce the yarn, but additional problems of complicating the process and making solvent management and recovery difficult arise.

Meanwhile, a low molecular weight polyethylene yarn having a low viscosity is disadvantageous for post-processing such as weaving, knitting, and heat treatment, due to its low strength, high elongation, and low dimensional stability, as compared with the high molecular weight polyethylene yarn having a high viscosity. Thus, the low molecular weight polyethylene yarn has low industrial availability as compared with the high molecular weight polyethylene yarn and is not utilized for various applications.

Thus, the present applicant developed a polyethylene yarn having high dimensional stability while including a low molecular weight polyethylene having a low viscosity, thereby easily performing a spinning process by an inherent high melt flowability of polyethylene, without dilution in a separate solvent, and providing a polyethylene yarn having excellent dimensional stability so that it has a low dimensional deformation rate in post-processing such as weaving and cutting dyeing, and mechanical properties.

In the present specification, the polyethylene yarn refers to a monofilament and a multifilament manufactured by a process such as spinning and drawing, using polyethylene chips as a raw material. As an example, the polyethylene fiber May include 40 to 500 filaments each having a fineness of 1 to 3 denier, and may have a total fineness of 100 to 1,000 denier.

The polyethylene yarn of the present invention has a maximum thermal shrinkage stress of 0.1 to 0.7 g/d and a melt index (MI, @190° C.) of 5 to 10 g/10 min, and though it includes a low molecular weight polyethylene, it has excellent thermal shrinkage, that is, excellent dimensional stability. Thus, unlike the case of including a high molecular weight polyethylene having a high viscosity, it is not necessary to dilute the yarn in a separate solvent in a spinning process, thereby simplifying the process, and thus, yarn productivity is very high, shape is not deformed in post-processing such as weaving and twisting, and thermal conductivity may be excellent. In addition, since the polyethylene yarn has excellent thermal conductivity and dimensional stability, it may be manufactured into a fabric having excellent physical properties such as cool feeling properties.

The dimensional stability of the polyethylene yarn according to the present invention is a characteristic of resistance to dimensional deformation by heat, pressure, tension, and the like in post-processing such as weaving or knitting of a yarn into a fabric, and may refer to shape stability. The higher the dimensional stability is, the smaller the dimensional deformation rate in the post-processing is.

The cool feeling of a fabric including the polyethylene yarn according to the present invention is a characteristic allowing a user wearing the fabric to feel an appropriate cooling sensation, that is, coolness through a high thermal conductivity of the yarn. Specifically, in the case of a polymer, heat is transferred mainly through lattice vibration called a phonon in the polymer (in particular, in a direction of a molecular chain connected by a covalent bond). That is, the thermal conductivity of the yarn may be adjusted differently depending on the structural characteristics of the polymer itself, such as crystallinity and orientation degree of the yarn, even in the case in which the yarn is a yarn manufactured from the same resin.

As described above, the polyethylene yarn may have a maximum thermal shrinkage stress of 0.1 to 0.7 g/d, specifically 0.2 to 0.5 g/d and a melt index (MI, @190° C.) of 5 to 25 g/10 min, specifically 6 to 15 g/10 min, but is not limited thereto. However, within the range, the polyethylene yarn may have better dimensional stability and thermal conductivity. In addition, the polyethylene yarn as such has a low viscosity at the time of melting, and in a spinning process, spinning is possible without a separate solvent, and thus, spinning efficiency is excellent.

In particular, a polyethylene yarn includes a low molecular weight polyethylene, and may have a polydispersity index (PDI) of 5 to 20, specifically 8 to 18, and more specifically 10 to 15 and a number average molecular weight (Mn) of 1000 to 10,000 g/mol, specifically 2000 to 5000 g/mol. The polyethylene yarn having the polydispersity index and the number average molecular weight in the above range secures processability, for example, has good flowability of a melt during melt extrusion of the yarn, prevents occurrence of thermal decomposition, and has no occurrence of breakage during spinning, thereby allowing manufacture of a yarn having uniform physical properties, and providing a yarn having excellent durability. Here, a weight average molecular weight is not limited as long as the PDI value described above is satisfied for the number average molecular weight described above, but the weight average molecular weight may be lower than that of a common polyethylene yarn for a cool feeling. Specifically, the weight average molecular weight may be 20,000 to 90,000 g/mol, specifically 35,000 to 75,000 g/mol.

In addition, the polyethylene yarn may have a density of 0.92 to 0.97 g/cm$^3$ and a crystallinity by spinning of 60 to 90%, specifically 65 to 85%. The crystallinity of the polyethylene yarn may be derived with a microcrystalline size in crystallinity analysis using an X-ray diffraction analyzer. As described above, heat is rapidly diffused and dissipated through lattice vibration called a "phonon" in a direction of molecular chain connected by a covalent bond of polyethylene in a range in which crystallinity satisfies the range, and a function to discharge moisture such as sweat and breath is improved, thereby providing a fabric having an excellent cool feeling.

Further, the polyethylene yarn may have a strength of 6 to 17 g/d, specifically 10 to 15 g/d as measured according to ASTM D2256, and an elongation of 10 to 25%, specifically 12 to 20%. The polyethylene yarn having the strength and the elongation in the above range may have excellent weaving properties with relatively high flexibility as well as excellent thermal conductivity, and thus, when woven later to be manufactured into a fabric, a fabric having better quality may be obtained.

Hereinafter, a method for manufacturing a polyethylene yarn according to an embodiment of the present invention will be described in detail, with reference to FIG. 1. The manufacturing method is not limited as long as the polyethylene yarn of the present invention satisfies the range of the physical properties such as PDI, strength, and elongation, and an embodiment is described in the following.

First, polyethylene in the form of chips is introduced into an extruder 100 and melted to obtain a polyethylene melt.

The molten polyethylene is transported through a spinneret 200 by a screw (not shown) in the extruder 100, and extruded through a plurality of holes formed in the spinneret 200. The number of holes of the spinneret 200 may be determined by the denier per filament (DPF) and the fineness of the yarn to be manufactured. For example, when a yarn having a total fineness of 75 deniers is manufactured, the spinneret 200 may have 20 to 75 holes, and when a yarn having a total fineness of 450 deniers is manufactured, the spinneret 200 may have 90 to 450, preferably 100 to 400 holes.

A melting process in the extruder 100 and an extrusion process by the spinneret 200 may be changed and applied depending on the melt index of the polyethylene chips, but specifically, for example, may be performed at 150 to 315° C., preferably 250 to 315° C., and more preferably 265 to 310° C. That is, it is preferred that the extruder 100 and the spinneret 200 may be maintained at 150 to 315° C., preferably 250 to 315° C., and more preferably 265 to 310° C.

When the spinning temperature is lower than 150° C., polyethylene does not melt uniformly due to the low spinning temperature, so that the spinning may be difficult. However, when the spinning temperature is higher than 315° C., thermal decomposition of polyethylene is caused, so that a desired strength may not be expressed.

A ratio (L/D) of a hole length (L) to a hole diameter (D) of the spinneret 200 may be 3 to 40. When L/D is less than 3, die swell occurs during melt extrusion and it becomes hard to control the elastic behavior of polyethylene to deteriorate spinning properties, and when L/D is more than 40, breakage due to necking of molten polyethylene passing through a spinneret and discharge non-uniformity due to pressure drop may occur.

As the molten polyethylene is discharged from holes of the spinneret 200, solidification of polyethylene starts due to a difference between a spinning temperature and room temperature to form filaments 11 in a semi-solidified state. In the present specification, not only the filaments in a semi-solidified state but also completely solidified filaments are collectively referred to as "filaments".

A plurality of filaments 11 are cooled in a cooling unit (or "quenching zone") (300) to be completely solidified. The filaments 11 may be cooled in an air cooling manner.

It is preferred that the cooling of the filaments 11 in the cooling unit 300 may be performed using a cooling air at a wind speed of 0.2 to 1 m/sec so that the filaments are cooled to 15 to 40° C. When the cooling temperature is lower than 15° C., elongation is insufficient due to supercooling so that breakage may occur in a drawing process, and when the cooling temperature is higher than 40° C., a fineness deviation between filaments 11 is increased due to solidification unevenness and breakage may occur in the drawing process.

In addition, multi-stage cooling is performed during cooling in the cooling unit to perform more uniform crystallization, and thus, moisture and sweat may be discharged more smoothly and a yarn having an excellent cool feeling may be manufactured. More specifically, the cooling unit may be divided into two or more sections. For example, when the cooling unit is composed of two cooling sections, it is preferred to design the cooling unit so that the temperature is gradually lowered from a first cooling unit to a second cooling unit. Specifically, for example, the first cooling unit may be set at 40 to 90° C., and the second cooling unit may be set at 15 to 50° C.

In addition, a wind speed is set highest in the first cooling unit, thereby manufacturing a fiber having a smoother surface. Specifically, the first cooling unit is cooled to 40 to 90° C. using a cooling wind at a wind speed of 0.8 to 1.0 m/sec and the second cooling unit is cooled to 15 to 50° C. using a cooling wind at a wind speed of 0.3 to 1.0 m/sec, and by adjusting the cooling units under the conditions as such, a yarn having higher crystallinity and a smoother surface may be manufactured.

Subsequently, the cooled and completed solidified filaments 11 are collected by a collecting machine 400 to form a multifilament 10.

As illustrated in FIG. 1, the polyethylene yarn of the present invention may be manufactured by a direct spinning drawing (DSD) process. That is, the multifilament 10 may be directly transported to a multi-stage drawing unit 500 including a plurality of godet roller units ($GR_1$, . . . . $GR_n$), subjected to a multi-stage drawing at a total drawing ratio of 2 to 20 times, preferably 3 to 15 times, and then wound up in a winder 600. In addition, in the last drawing section in the multi-stage drawing, shrinkage a 1 to 5% drawing (relaxation) may be imparted to provide a yarn having better durability.

Alternatively, the multifilament 10 are wound up once as an undrawn yarn, and then the undrawn yarn is drawn, thereby manufacturing the polyethylene yarn of the present invention. That is, the polyethylene yarn of the present invention may be manufactured by a two-step process in which polyethylene is melt-spun to manufacture an undrawn yarn once, and then the undrawn yarn is drawn.

When the total drawing ratio applied in the drawing process is less than 2, the polyethylene yarn finally obtained may not have a crystallinity of 60% or more, and there is a risk of causing lint (peeling) on the fabric manufactured by the yarn.

However, when the total drawing ratio is more than 15 times, breakage may occur, the strength of the finally obtained polyethylene yarn is not appropriate, so that the weaving properties of the polyethylene yarn may not be good, and the fabric manufactured using the yarn is too stiff, so that a user may feel uncomfortable.

When a linear speed of the first godet roller unit ($GR_1$) which determines the spinning speed of the melt spinning of the present invention is determined, the liner speeds of the remaining godet roller units are appropriately determined, so that a total drawing ratio of 2 to 20, preferably 3 to 15 may be applied to the multifilament 10 in the multi-stage drawing unit 500.

According to an exemplary embodiment of the present invention, the temperature of the godet roller units ($GR_1$, . . . $GR_n$) in the multi-stage drawing unit 500 is appropriately set in a range of 40 to 150° C., thereby performing heat setting of the polyethylene yarn by the multi-stage drawing unit 500. Specifically, for example, the multi-stage drawing unit may be composed of 3 or more, specifically 3 to 5 drawing 13 sections. In addition, each drawing section may be composed of a plurality of godet roller units.

Specifically, for example, the multi-stage drawing unit may be composed of 4 drawing sections, in which drawing may be performed at a total drawing ratio of 7 to 15 times in a first drawing section to a third drawing section, and then a 1 to 3% shrinkage drawing (relaxation) may be performed in a fourth drawing section. The total drawing ratio refers to a final drawing ratio of a fiber passing through the first drawing section to the third drawing section, as compared with a fiber before drawing.

More specifically, in the first drawing section, drawing may be performed at 40 to 120° C. and a total drawing ratio may be 2 to 5 times. In the second drawing section, drawing may be performed at a higher temperature than the first drawing section, specifically at 90 to 140° C., and may be performed so that the total drawing ratio is 5 to 8 times. In the third drawing section, drawing may be performed at 90 to 140° C., and may be performed so that the total drawing ratio is 7 to 15 times. In the fourth section, drawing may be performed at a temperature equivalent to or lower than the third drawing section, specifically at 90 to 140° C., and a 1 to 3% shrinkage drawing (relaxation) may be performed.

The multi-stage drawing and the heat-setting of the multifilament 10 are performed simultaneously by the multi-stage drawing unit 500, and the multi-stage drawn multifilament 10 is wound up in a winder 600, thereby completing the polyethylene yarn of the present invention.

The functional fabric according to the present invention includes the polyethylene yarn described above, and by including excellent thermal conductivity and high dimensional stability, the fabric may have excellent quality with cool feeling properties.

The functional fabric according to the present invention may use the polyethylene yarn described above alone, and in order to further impart other functions, a heterogeneous yarn may be further included, but it is preferred to use the polyethylene yarn alone in terms of having both the cool feeling and the dimensional stability.

Specifically, the functional fabric includes the yarn described above, thereby having an excellent cool feeling. Specifically, the functional fabric may have a cool feeling on contact of 0.05 to 0.25 W/cm$^2$ as measured by bringing the fabric at 20±2° C. into contact with a hot plate (T-box) at 30±2° C. under the conditions of 20±2° C. and 65±2% R.H, and a thermal conductivity in a thickness direction of 0.05 to 0.25 W/mk as measured by bringing the fabric at 20±2° C. into contact with a heat source plate (BT-box) at 30±2° C. under the conditions of 20±2° C. and 65±2% R.H. More specifically, the cool feeling on contact may be 0.07 to 0.20 W/cm$^2$ and the thermal conductivity in the thickness direction may be 0.07 to 0.20 W/mk. The functional fabric having a cool feeling as such may provide an appropriate cool feeling to make a user feel comfortable under high temperature environments, when the fabric is manufactured or processed into a product later and worn by the user.

In addition, the functional fabric includes the polyethylene yarn described above, thereby having excellent dimensional stability. Specifically, when the functional fabric is manufactured by weaving or knitting the polyethylene yarn described above, the finally manufactured fabric has almost no dimensional deformation rate for a designed dimension and has few defective products, and may have excellent quality.

In addition, the functional fabric includes the yarn having a specific thermal shrinkage stress described above, thereby having excellent dimensional stability even under harsh conditions of a high temperature. Specifically, the dimensional deformation rate represented by the following Equation 1 may be −2.0% to 2.0%, preferably −1.8% to 1.8%, and more preferably-1.5% to 1.5%, under the conditions of 90±2° C. and 65±2% R.H:

$$\text{Dimensional deformation rate (\%)} = \{(FS_1 - FS_0)/(FS_0)\} \times 100 \quad \text{[Equation 1]}$$

wherein $FS_0$ is a functional fabric dimension (mm) measured after allowing the functional fabric to stand at room temperature (20±2° C., 65±2% R.H) for 24 hours, and $FS_1$ is a functional fabric dimension (mm) measured after allowing the functional fabric to stand under the conditions of 90±2° C. and 65±2% R.H for 24 hours.

As such, the functional fabric has excellent dimensional stability even under harsh conditions, and thus, secures dimensional stability in post-processing under various external forces such as heat and pressure, thereby having excellent post-processability.

In addition, the functional fabric may be a woven fabric or knitted fabric having a weight per unit area (that is, surface density) of 150 to 800 g/m$^2$. When the fabric has a surface density of less than 150 g/m$^2$, fabric compactness is insufficient and many pores exist in the fabric, and these pores reduce the cool feeling of the fabric. However, when the fabric has a surface density of more than 800 g/m$^2$, the fabric becomes stiff due to the excessively dense structure of the fabric, problems with user's tactile sensation occur, and problems in use arise due to its high weight.

The fabric as such may be processed into a cool feeling product requiring an appropriate cool feeling. The product may be any conventional fiber product, but preferably, may be summer clothes, sportswear, masks, and work clothes for imparting a cool feeling to a human body.

Hereinafter, the present disclosure will be described in more detail through the following examples. However, the following exemplary embodiments are only a reference for describing the present invention in detail, and the present invention is not limited thereto, and may be implemented in various forms.

In addition, unless otherwise defined, all technical terms and scientific terms have the same meanings as those commonly understood by a person skilled in the art to which the present invention pertains. The terms used herein are only for effectively describing a certain exemplary embodiment, and not intended to limit the present invention. Further, unless otherwise stated, the unit of added materials herein May be wt %.

The physical properties were measured as follows.

[Measurement of Physical Properties of Yarn]

<1. Thermal Shrinkage Stress>

Both ends of a polyethylene yarn were tied to make a loop-shaped sample, both sides of the loop-shaped sample were placed in a hot chamber of a thermal stress tester (Kanebo Eng., KE-2, Japan), the both sides of the loop sample were hung on a load cell and primary rings, respectively, and a maximum thermal shrinkage stress was measured under the following conditions. At this time, loop circumference length was 10 cm.

Load cell: a load cell measurable to 500 gf

Initial temperature: room temperature (20±2° C.)

Heating rate: 300° C./120 sec

Primary load: 0.06667 g/d

The thermal shrinkage stress value was obtained by a graph through an output device (Type 3086 X-T Recorder, Yokogawa Hokushin Electric, Tokyo, Japan).

21<2. Number Average Molecular Weight (Mn) (g/mol), Weight Average Molecular Weight (Mw) (g/mol), and Polydispersity Index (PDI)>

A polyethylene yarn was completely dissolved in the following solvent and then each of the weight average molecular weight (Mw) and the polydispersity index (Mw/Mn: PDI) of the polyethylene yarn were determined, respectively, using the following gel permeation chromatography (GPC).

Analytical instrument: HLC-8321 GPC/HT available from Tosoh Corporation

Column: PLgel guard (7.5×50 mm)+2× PLgel mixed-B (7.5×300 mm)

Column temperature: 160° C.

Solvent: trichlorobenzene (TCB)+0.04 wt % of dibutylhydroxytoluene (BHT) (after drying with 0.1% $CaCl_2$))

Injector, Detector temperature: 160° C.

Detector: RI Detector

Flow velocity: 1.0 ml/min

Injection amount: 300 mL

Sample concentration: 1.5 mg/mL

Standard sample: polystyrene

<3. Strength (g/d) and Elongation (%)>

According to the method of ASTM D2256, a universal tensile tester available from Instron (Instron Engineering Corp, Canton, Mass) was used to obtain a strain-stress curve of the polyethylene yarn. A sample length was 250 mm, a tensile speed was 300 mm/min, and an initial load was set to 0.05 g/d. The strength (g/d) and the elongation (%) were obtained from a stress and a stretch at break, and the initial modulus (g/d) was determined from a tangent to impart a maximum gradient near the starting point of the curve. The measurement was performed five times for each yarn and the average value was calculated.

<4. Crystallinity>

An XRD instrument (X-ray Diffractometer) [manufacturer: PANalytical, model name: EMPYREAN] was used to measure the crystallinity of the polyethylene yarn. Specifically, the polyethylene yarn was cut to prepare a sample having a length of 2.5 cm, the sample was fixed to a sample holder, and the measurement was performed under the following conditions:

Light source (X-ray Source): Cu-Kα radiation

Power: 45 KV×25 mA

Mode: continuous scan mode

Scan angle range: 10 to 40°

Scan speed: 0.1°/sec

[Measurement of Physical Properties of Fabric]

<1. Cool Feeling on Contact>

The Korea Apparel Testing & Research Institute was commissioned to perform measurement under 20±2° C. and 65±2% R.H, using a KES-F7 device (Thermo Labo II).

Specifically, a fabric sample having a size of 20 cm×20 cm was prepared, and was allowed to stand for 24 hours under the conditions of a temperature of 20±2° C. and 65±2% RH. Subsequently, a KES-F7 THERMO LABO II device (Kato Tech Co., LTD.) was used to measure the thermal conductivity and the heat transfer coefficient of the fabric under the test environments of a temperature of 20±2° C. and 65±2% RH The cool feeling (Q max) of the fabric was measured using a device. Specifically, as illustrated in FIG. 2, the fabric sample 23 was placed on a base plate (also referred to as "Water-Box") 21 maintained at 20° C., and a hot plate (T-Box, 22*a*) heated to 30° C. (contact area: 3 cm×3 cm) was placed on the fabric sample 23 only for 1 second. That is, the other surface of the fabric sample 23 of which one surface was in contact with a base plate 21 was momentarily brought into contact with T-Box 22*a*. A contact pressure applied to the fabric sample 23 by the T-Box 22*a* was 6 gf/cm$^2$. Subsequently, a Q max value displayed in a monitor (not shown) connected to the device was recorded. The test was repeated 10 times, and an arithmetic mean of the Q max value was calculated.

<2. Thermal Conductivity>

A fabric sample having a size of 20 cm×20 cm was prepared, and was allowed to stand for 24 hours under the conditions of a temperature of 20±2° C. and 65±2% RH. Subsequently, a KES-F7 THERMO LABO II device (Kato Tech Co., LTD.) was used to determine the thermal conductivity and the heat transfer coefficient of the fabric under the test environments of a temperature of 20±2° C. and 65±2% RH. Specifically, as illustrated in FIG. 3, the fabric sample 23 was placed on the base plate 21 maintained at 20° C., and BT-Box 22*b* (contact area: 5 cm×5 cm) heated to 30° C. was placed on the fabric sample 23 for 1 minute. Heat was continuously supplied to the BT-Box 22*b* so that the temperature was maintained at 30° C. even while the BT-Box 22*b* was in contact with the fabric sample 23. A heat quantity supplied for temperature maintenance of the BT-Box 22*b* (that is, heat flow loss) was displayed on a monitor connected to the device. The test was repeated 5 times, and an arithmetic mean of the heat flow loss was calculated. Subsequently, the thermal conductivity and the heat transfer coefficient of the fabric were calculated using the following Equations 2 and 3:

$$K = (W \cdot D)/(A \cdot \Delta T) \quad \text{[Equation 2]}$$

$$k = K/D \quad \text{[Equation 3]}$$

wherein K is thermal conductivity (W/cm·° C.), D is a thickness of the fabric sample 23, A is a contact area (=25 $cm^2$) of the BT-Box 22*b*, ΔT is a temperature difference (=10° C.) between both surfaces of the fabric sample 23, W is heat flow loss (Watt), and k is a thermal transfer coefficient ($W/cm^2 \cdot$° C.).

<3. Dimensional Stability>

A fabric sample having a size of 20 cm×20 cm was prepared, and was allowed to stand for 24 hours under the conditions of a temperature of 20±2° C. and 65±2% RH. Thereafter, a dimension of one edge for the fabric sample was measured.

Thereafter, the sample was allowed to stand under the conditions of a temperature of 90±2° C. and 65±2% RH for 24 hours, and the dimension was measured again by the method described above. Subsequently, the dimensional deformation rate of the fabric was calculated by the following Equation 1:

$$\text{Dimensional deformation rate (\%)} = \{(FS_1 - FS_0)/(FS_0)\} \times 100 \quad \text{[Equation 1]}$$

wherein $FS_0$ is a functional fabric dimension (mm) measured after weaving the functional fabric and allowing the functional fabric to stand at room temperature (20±2° C., 65±2% R.H) for 24 hours, and $FS_1$ is a functional fabric dimension (mm) measured after weaving the functional fabric and allowing the functional fabric to stand under the conditions of 90±2° C. and 65±2% R. H for 24 hours.

Example 1

<Manufacture of Polyethylene Yarn>

A device illustrated in FIG. 1 was used to manufacture a polyethylene yarn including 200 filaments and having a total fineness of 400 denier.

First, polyethylene chips having a density of 0.93 $g/cm^3$ and a weight average molecular weight (Mw) of 8.500 g/mol were added to an extruder 100 and melted. The molten polyethylene was extruded through a spinneret 200 having 200 holes. L/D which is a ratio of a hole length (L) to a hole diameter (D) of the spinneret was 6. A spinneret temperature was 270° C.

Filaments 11 formed by being discharged from nozzle holes of the spinneret 200 were sequentially cooled in a cooling unit 300 composed of two sections. The filaments were cooled to 60° C. by a cooling wind at a wind speed of 1.0 m/sec in the first cooling unit and were finally cooled to 30° C. by a cooling wind at a wind speed of 0.5 m/sec in the second cooling unit. After cooling, the filaments were collected into a multifilament yarn 10 by a collecting machine 400.

Subsequently, the multifilament yarn was transported to a drawing unit 500. The drawing unit was composed of a multi-stage drawing part composed of four sections and was composed of a total of four stages of godet roller units, and each godet roller unit was composed of 2 to 6 godet rollers.

Specifically, drawing and heat setting were performed by drawing at a total drawing ratio of 2 times at a highest drawing temperature of 80° C. in a first drawing section, drawing at a total drawing ratio of 1.5 times at a highest drawing temperature of 120° C. in a second drawing section, drawing at a total drawing ratio of 1.3 times at a highest drawing temperature of 120° C. in a third drawing section, and a 2% shrinkage drawing (relaxation) as compared with the third drawing section at a highest drawing temperature of 120° C. in a fourth drawing section.

Subsequently, the drawn multifilament yarn was wound up in a winder 600. A winding tension was 0.8 g/d.

The physical properties of the thus-manufactured yarn were measured, and are shown in the following Table 1.

The thermal shrinkage stress graph measured is shown in FIG. 4.

<Manufacture of Functional Fabric>

The polyethylene yarn manufactured above was woven to manufacture a functional fabric having a surface density of 500 $g/m^2$. The physical properties of the thus-manufactured fabric were measured, and are shown in the following Table 3.

Examples 2 to 9

Fabrics were manufactured in the same manner as in Example 1, except that the yarn conditions were changed as shown in Table 1. In addition, the physical properties of the fabric manufactured in the same manner as in Example 1 were measured and are shown in Table 3. In the case of Example 7, the thermal shrinkage stress graph measured is shown in FIG. 5.

Comparative Examples 1 and 2

Fabrics were manufactured in the same manner as in Example 1, except that the yarn conditions were changed as shown in Table 2. In addition, the physical properties of the fabric manufactured in the same manner as in Example 1 were measured and are shown in Table 4.

Comparative Example 3

A yarn and a fabric were manufactured in the same manner as in Example 1, except that yarn conditions were changed as shown in Table 2 and the number of drawing sections was 2. In addition, the physical properties of the fabric manufactured in the same manner as in Example 1 were measured and are shown in Table 4.

Comparative Example 4

A yarn and a fabric were manufactured in the same manner as in Example 1, except that yarn conditions were changed as shown in Table 2 and the number of drawing sections was 6. In addition, the physical properties of the fabric manufactured in the same manner as in Example 1 were measured and are shown in Table 4.

TABLE 1

| | | Example 1 | Example 2 | Example 3 | Example 4 | Example 5 | Example 6 | Example 7 | Example 8 | Example 9 |
|---|---|---|---|---|---|---|---|---|---|---|
| Physical properties of yarn | Maximum thermal shrinkage stress (g/d) | 0.3 | 0.35 | 0.30 | 0.25 | 0.69 | 0.32 | 0.52 | 0.52 | 0.43 |
| | Melt index (g/10 min) | 9.71 | 10.13 | 10.92 | 10.15 | 15.73 | 10.82 | 10.14 | 6.79 | 6.34 |
| | PDI | 16.2 | 11.9 | 11.8 | 12.2 | 12.5 | 5.4 | 19.8 | 12.3 | 12.4 |
| | Mn (g/mol) | 8223 | 8522 | 8543 | 8531 | 8319 | 6533 | 3134 | 13527 | 22001 |
| | Crystallinity (%) | 71.3 | 73.2 | 74.2 | 75.3 | 71.8 | 71.3 | 68.7 | 77.1 | 76.4 |
| | Strength (%) | 8.2 | 9.1 | 9.5 | 9.8 | 8.0 | 13.4 | 7.2 | 15.1 | 15.23 |
| | Elongation (%) | 17.2 | 16.3 | 14.1 | 12.4 | 17.8 | 11.4 | 23.2 | 9.13 | 8.15 |

TABLE 2

| | | Comparative Example 1 | Comparative Example 2 | Comparative Example 3 | Comparative Example 4 |
|---|---|---|---|---|---|
| Physical properties of yarn | Maximum thermal shrinkage stress (g/d) | 0.8 | 0.92 | 0.93 | 0.05 |
| | Melt index (g/10 min) | 10.7 | 2.1 | 10.7 | 10.9 |
| | PDI | 24.8 | 6.9 | 16.1 | 15.7 |
| | Mn (g/mol) | 4525 | 12451 | 8754 | 8321 |
| | Crystallinity (%) | 65.1 | 67.6 | 61.2 | 74.1 |
| | Strength (%) | 6.8 | 8.2 | 7.5 | 9.3 |
| | Elongation (%) | 21.1 | 10.2 | 20.5 | 7.5 |

TABLE 3

| | | Example 1 | Example 2 | Example 3 | Example 4 | Example 5 | Example 6 | Example 7 | Example 8 | Example 9 |
|---|---|---|---|---|---|---|---|---|---|---|
| Physical properties of fabric | Cool feeling on contact ($W/cm^2$) | 0.17 | 0.17 | 0.18 | 0.195 | 0.16 | 0.18 | 0.10 | 0.17 | 0.16 |
| | Thermal conductivity in thickness direction (W/mK) | 0.08 | 0.12 | 0.16 | 0.18 | 0.09 | 0.10 | 0.06 | 0.12 | 0.13 |
| | Dimensional deformation rate (%) | 1.5 | 1.2 | 1.0 | 0.8 | 1.6 | 1.4 | 1.8 | 2.1 | 2.3 |

TABLE 4

| | | Comparative Example 1 | Comparative Example 2 | Comparative Example 3 | Comparative Example 4 |
|---|---|---|---|---|---|
| Physical properties of fabric | Cool feeling on contact ($W/cm^2$) | 0.08 | 0.10 | 0.08 | 0.10 |
| | Thermal conductivity in thickness direction (W/mK) | 0.05 | 0.06 | 0.05 | 0.09 |
| | Dimensional deformation rate (%) | 3.8 | 2.3 | 4.8 | 1.8 |

Referring to Tables 1 to 4, it was confirmed that the yarn according to the examples had an appropriate cool feeling and had excellent dimensional stability. In particular, in Comparative Example 4, it was confirmed that the fabric was manufactured using a yarn having a relatively high crystallinity, but a large amount of fluff occurred, and thus, the fabric had a low cool feeling on contact and a low thermal conductivity.

Hereinabove, although the present invention has been described by specific matters, limited exemplary embodiments, and drawings, they have been provided only for assisting the entire understanding of the present invention, and the present invention is not limited to the exemplary embodiments, and various modifications and changes may be made by those skilled in the art to which the present invention pertains from the description.

Therefore, the spirit of the present invention should not be limited to the above-described exemplary embodiments, and the following claims as well as all modified equally or equivalently to the claims are intended to fall within the scope and spirit of the invention.

| [Detailed Description of Main Elements] | |
|---|---|
| 10: Multifilament | 11: Filament |
| 21: Base plate | 23: Fabric |
| 22a: T-box | 22b: BT-box |
| 100: Extruder | 200: Spinneret |
| 300: Cooling unit | 400: Collecting machine |
| 500: Drawing unit | 700: Winder |

The invention claimed is:

1. A polyethylene yarn having a number average molecular weight (Mn) of 1000 to 10,000 g/mol, a maximum thermal shrinkage stress of 0.1 to 0.7 g/d and a melt index (MI, @190° C.) of 5 to 25 g/10 min.

2. The polyethylene yarn of claim 1, wherein
the yarn has a polydispersity index (PDI) of 5 to 20.

3. The polyethylene yarn of claim 1, wherein
the yarn has a strength of 6 to 17 g/d as measured according to ASTM D2256 and an elongation of 10 to 25%.

4. The polyethylene yarn of claim 1, wherein
the yarn has a crystallinity of 65 to 85%.

5. The polyethylene yarn of claim 1, wherein
the yarn has a density of 0.92 to 0.97 g/cm3.

6. A functional fabric comprising the polyethylene yarn of claim 1,
the functional fabric has a dimensional deformation rate of −1.8% to 1.8%, as represented by the Equation 1, $$\text{Dimensional deformation rate } (\%)=\{(FS_1-FS_0)/(FS_0)\}\times 100 \quad \text{[Equation 1]}$$

wherein $FS_0$ is a functional fabric dimension (mm) measured after allowing the functional fabric to stand at room temperature (20±2° C., 65±2% R.H) for 24 hours, and $FS_1$ is a functional fabric dimension (mm) measured after allowing the functional fabric to stand under the conditions of 90±2° C. and 65±2% R.H for 24 hours.

7. A functional fabric of claim 6, wherein
the fabric has a cool feeling on contact of 0.05 to 0.25 W/cm2, as measured by bringing the fabric at 20±2° C. into contact with a hot plate (T-box) at 30±2° C. under conditions of 20±2° C. and 65±2% R.H.

8. A functional fabric of claim 6, wherein
the fabric has a thermal conductivity of 0.05 to 0.25 W/mK, as measured by bringing the fabric at 20±2° C. into contact with a heat source plate (BT-box) at 30±2° C. under conditions of 20±2° C. and 65±2% R.H.

9. A functional fabric of claim 6, wherein
the fabric has a surface density of 150 to 800 g/m$^2$.

10. A cool feeling product manufactured from the fabric of claim 6.

* * * * *